US009618882B2

(12) United States Patent
Rokugawa

(10) Patent No.: US 9,618,882 B2
(45) **Date of Patent: *Apr. 11, 2017**

(54) IMAGE FORMATION APPARATUS THAT CHANGES A VOLTAGE TO SECONDARY TRANSFER UNITS BASED ON ARRANGEMENT OF IMAGE FORMATION UNITS

(71) Applicant: Oki Data Corporation, Tokyo (JP)

(72) Inventor: Hiroshi Rokugawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 3 days.

This patent is subject to a terminal disclaimer.

(21) Appl. No.: 14/825,216

(22) Filed: Aug. 13, 2015

(65) Prior Publication Data

US 2016/0179037 A1 Jun. 23, 2016

(30) Foreign Application Priority Data

Dec. 18, 2014 (JP) ..... 2014-256407

(51) Int. Cl.
*G03G 15/16* (2006.01)
*G03G 15/01* (2006.01)

(52) U.S. Cl.
CPC ..... *G03G 15/1675* (2013.01); *G03G 15/1605* (2013.01); *G03G 2215/0129* (2013.01)

(58) Field of Classification Search
CPC ..... G03G 15/1605; G03G 15/0131; G03G 2215/0122
See application file for complete search history.

(56) References Cited

U.S. PATENT DOCUMENTS

2004/0037573 A1* 2/2004 Hirota ..... G03G 15/0121 399/12
2015/0023678 A1* 1/2015 Rokugawa ..... G03G 15/1675 399/66

FOREIGN PATENT DOCUMENTS

JP 2014-106401 A 6/2014

* cited by examiner

*Primary Examiner* — David Gray
*Assistant Examiner* — Andrew V Do
(74) *Attorney, Agent, or Firm* — Mots Law, PLLC

(57) ABSTRACT

An image formation apparatus includes: image formation units each configured to form a developer image; an intermediate transfer body onto which the developer images formed by the respective image formation units are transferred; a secondary transfer member configured to transfer the developer images, which are transferred to the intermediate transfer body, onto a record medium using a voltage supplied to the secondary transfer member; and a voltage supply unit configured to supply a voltage to the secondary transfer member. Arrangement of the image formation units is changeable. Depending on the arrangement of the image formation units in a conveyance direction of the intermediate transfer body, the voltage supply unit changes a voltage to be supplied to the secondary transfer member.

19 Claims, 6 Drawing Sheets

IMAGE FORMATION APPARATUS THAT CHANGES A VOLTAGE TO SECONDARY TRANSFER UNITS BASED ON ARRANGEMENT OF IMAGE FORMATION UNITS

CROSS REFERENCE TO RELATED APPLICATIONS

This application claims priority based on 35 USC 119 from prior Japanese Patent Application No. 2014-256407 filed on Dec. 18, 2014, entitled "IMAGE FORMATION APPARATUS", the entire contents of which are incorporated herein by reference.

BACKGROUND OF THE INVENTION

1. Field of the Invention

This disclosure relates to an image formation apparatus configured to form an image on a record medium by electrophotography.

2. Description of Related Art

A conventional image formation apparatus uses image formation units each formed from a photosensitive drum, an electrical-charge device, a light-exposure device and a development device. For example, the image formation units for white, yellow, magenta, cyan and black are arranged in this order from the upstream side. The conventional image formation apparatus is configured to perform a primary transfer by transferring toner images from the image formation units for the respective colors sequentially onto an intermediate transfer belt, and to perform secondary transfer by transferring the toner images resulting from the primary transfer onto a record medium. In the case of a white single-color printing by the white image formation unit, toner fog may be generated due to unnecessary toner being attached to a non-image portion on the intermediate transfer belt in the primary transfer of the toner image from the white image formation unit. To address this, any one of the image formation units placed downstream of the most upstream white image formation unit is brought into contact with the intermediate transfer belt, and the photosensitive drum of the image formation unit downstream of the white image formation unit collects the toner forming the toner fog (see Japanese Patent Application Publication No. 2014-106401, for example).

SUMMARY OF THE INVENTION

Since the image formation units other than the white one are placed downstream of the white image formation unit, the conventional technique is somehow capable of reducing white toner fog by using the downstream image formation units performing reverse transfer. However, in a case of a configuration to form an uppermost layer by using white toner, the white image formation unit needs to be placed downstream of the other image formation units. This case poses a problem: the white toner fog cannot be reduced and may make heavy stain on a record medium.

An object of an embodiment of the invention is to prevent stain on the record medium.

An aspect of the invention is an image formation apparatus that includes: image formation units each configured to form a developer image; an intermediate transfer body onto which the developer images formed by the respective image formation units are transferred; a secondary transfer member configured to transfer the developer images, which are transferred to the intermediate transfer body, onto a record medium using a voltage supplied to the secondary transfer member; and a voltage supply unit configured to supply a voltage to the secondary transfer member. Arrangement of the image formation units is changeable. Depending on the arrangement of the image formation units in a conveyance direction of the intermediate transfer body, the voltage supply unit changes a voltage to be supplied to the secondary transfer member.

According to this aspect of the invention, the smear on the record medium can be inhibited.

DETAILED DESCRIPTION OF THE EMBODIMENTS

Figure 1:
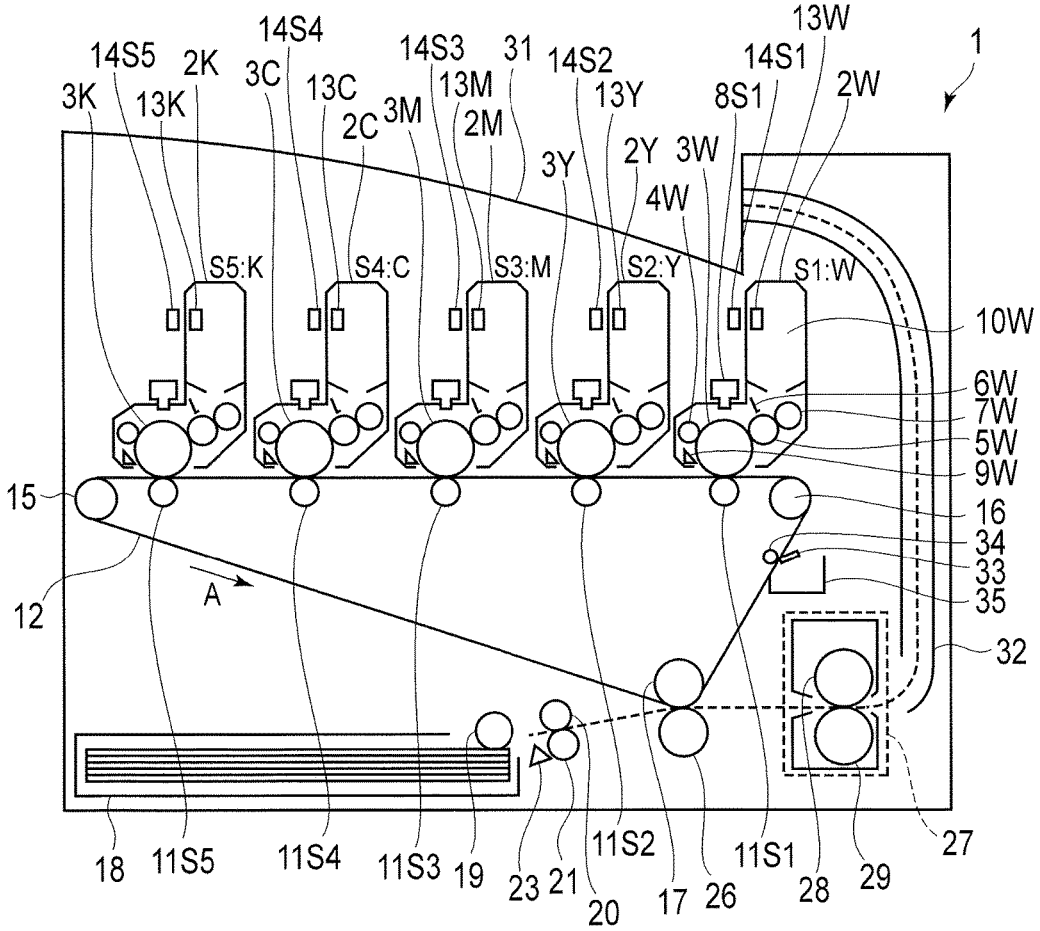
FIG. 1 is a schematic cross-sectional view illustrating a configuration of an image formation apparatus of an embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Referring to the drawings, descriptions are hereinbelow provided for an embodiment(s) of an image formation apparatus.

Embodiment

FIG. 1 is a schematic cross-sectional view illustrating a configuration of the image formation apparatus of the embodiment. In FIG. 1, image formation apparatus 1 is a color printer, for example. Image formation apparatus 1 includes image formation units each configured to form a toner image using a toner as a developer. The arrangement positions of the respective image formation units are interchangeable.

Five mutually-independent image formation units 2 (2W, 2Y, 2M, 2C, 2K) for five color (W: white, Y: yellow, M: magenta, C: cyan, K: black) toners as developers are disposed in image formation apparatus 1. The arrangement positions of image formation units 2W, 2Y, 2M, 2C, 2K are interchangeable. For example, an order of arrangement of image formation units 2W, 2Y, 2M, 2C, 2K from an upstream side in the conveyance direction of intermediate transfer belt 12, indicated with arrow A in FIG. 1, as illustrated in FIG. 1, can be changed to an order of arrangement of image formation units 2Y, 2M, 2C, 2K 2W from the upstream side. In other words, image formation unit 2W may be relocated from the most upstream position to the most downstream position.

Five image formation units 2W, 2Y, 2M, 2C, 2K are described in the embodiment. Nevertheless, the order of arrangement (disposition) of the image formation units, the number of image formation units, the toner colors or the pigments as the developers, and the like are not limited to those described in the embodiment. For example, image formation apparatus 1 may be image formation apparatus 1 which usually exclusively uses an image formation unit for black (K), but can also use an image formation unit for white (W) by replacing the image formation unit for black (K) with the image formation unit for white (W).

Furthermore, image formation units 2W, 2Y, 2M, 2C, 2K are provided with RF tags 13W, 13Y, 13M, 13C, 13K, each of which stores color information on a toner used in the corresponding image formation unit. Meanwhile, image formation apparatus 1 is provided with readers 14S1, 14S2, 14S3, 14S4, 14S5 configured to, when image formation units 2 are installed in image formation apparatus 1, read the color information from RF tags 13W, 13Y, 13M, 13C, 13K. Recognition of the order of arrangement of image formation unit 2 can be achieved by making readers 14S1, 14S2, 14S3, 14S4, 14S5 read the color information recorded in RF tags 13W, 13Y, 13M, 13C, 13K.

In this respect, the positions in which to place the image formation units in image formation apparatus 1 are denoted by S1, S2, S3, S4, S5 from the upstream side in the conveyance direction of intermediate transfer belt 12. For example, reader 14S1 means reader 14 placed in position S1 in image formation apparatus 1. The readers placed inside the main body of image formation apparatus 1 are hereinafter identified using reference signs S1, S2, S3, S4, S5.

Meanwhile, as a pigment, titanium dioxide is used for the toner corresponding to white (W). Titanium dioxide tends to cause much of the reversely-charged (not normally-charged) toner, and to make the fog become worse. For this reason, the back-side smear of the record media due to the fog during the printing operation is influenced by the position (order of position) in which to place image formation unit 2W.

It should be noted that image formation units 2W, 2Y, 2M, 2C, 2K have the same configuration. For this reason, descriptions are hereinbelow provided for image formation unit 2W as a representative.

Image formation unit 2W is formed from photosensitive drum 3W, charge roller 4W, development roller 5W, development blade 6W, supply roller 7W, cleaning roller 9W and toner cartridge 10W. Photosensitive drum 3W is an image carrier, and is rotatably supported.

Charge roller 4W is configured such that when a predetermined voltage is applied to charge roller 4W, charge roller 4W evenly charges the surface of photosensitive drum 3W in contact with charge roller 4W. LED (Light Emitting Diode) head 8S1 placed on the side of image formation apparatus 1 forms an electrostatic latent image on photosensitive drum 3W electrically charged by charge roller 4W. Light-emitting devices (LEDs) are arranged in LED head 8 (S1, S2, S3, S4, S5) in the main scanning direction. LED head 8 (S1, S2, S3, S4, S5) emits light onto photosensitive drum 3W based on image data inputted into LED head 8 from a host computer, and forms the electrostatic latent image on photosensitive drum 3W.

Development roller 5W forms a toner image as a developer image by attaching toner to the electrostatic latent image formed on photosensitive drum 3W. Development blade 6W forms a thin layer of the toner on development roller 5W while restricting the thickness of the toner supplied onto development roller 5W. Supply roller 7W is placed in contact with development roller 5W, and supplies the toner to development roller 5W. Cleaning roller 9W gets rid of fog toner and post-transfer residual toner which remain on photosensitive drum 3W, and reverse-transfer toner from the upstream-located image formation units 2, by scraping the fog toner, the post-transfer residual toner and the reverse-transfer toner from photosensitive drum 3W. Toner cartridge 10W stores the toner.

Primary transfer rollers 11S1, 11S2, 11S3, 11S4, 11S5 are placed under photosensitive drums 3 (3W, 3Y, 3M, 3C, 3K) of image formation units 2W, 2Y, 2M, 2C, 2K with intermediate transfer belt 12 interposed in between, respectively. Primary transfer rollers 11S1, 11S2, 11S3, 11S4, 11S5 form primary transfer nip portions by pressing intermediate transfer belt 12 against photosensitive drums 3W, 3Y, 3M, 3C, 3K.

The toner images formed respectively by image formation units 2W, 2Y, 2M, 2C, 2K are transferred onto intermediate transfer belt 12 as an intermediate transfer body. Intermediate transfer belt 12 is stretched among driving roller 15, driven roller 16 and secondary transfer opposing roller 17 with a predetermined tension. While rotated by a belt roller, driving roller 15 conveys intermediate transfer belt 12 in the direction indicated with arrow A in FIG. 1. Driven roller 16 rotates by being driven by intermediate transfer belt 12.

Under intermediate transfer belt 12, image formation apparatus 1 includes: sheet container cassette 18 configured to contain sheets as record media; hopping roller 19 configured to send the sheets contained in sheet container cassette 18; secondary transfer roller 26 configured to form a secondary transfer nip portion by pressing intermediate transfer belt 12 against secondary transfer opposing roller 17; pinch roller 20 configured to collect skewed feeding of the sheets; registration roller 21 configured to send the sheets to the secondary transfer nip portion; and sheet-feeder sensor 23 configured to detect whether or not each sheet reaches the interstice between pinch roller 20 and registration roller 21.

As a secondary transfer member, secondary transfer roller 26 transfers the toner images, which are transferred onto intermediate transfer belt 12, onto a record medium in accordance with the voltage supplied from a voltage supply unit. Secondary transfer roller 26 is placed opposite secondary transfer opposing roller 17 with intermediate transfer belt 12 interposed in between. Secondary transfer roller 26 is an electrically-conductive sponge roller. One with a peripheral length of 75 mm is used for secondary transfer roller 26. In addition, secondary transfer roller 26 rotates by being driven by intermediate transfer belt 12. Intermediate transfer belt 12 forms the secondary transfer nip portion by being pressed by secondary transfer roller 26 against secondary transfer opposing roller 17. Secondary transfer roller 26 transfers the toner images from intermediate transfer belt 12 onto the sheet. Thereafter, the resultant sheet is separated from intermediate transfer belt 12, and is conveyed to fuser mechanism 27.

Fuser mechanism 27 fixes the toner images onto the sheet by heating and fusing the toners which are transferred to the sheet. Fuser mechanism 27 is formed from heat roller 28 and pressure roller 29 which is configured to press heat roller 28, and the like. A heat motor drives heat roller 28, and pressure roller 29 rotates by being driven by heat roller 28. In addition, heat roller 28 includes a heater, such as a halogen lamp, inside itself. Transfer guide 32 is configured to convey the sheet to stacker 31 in the upper portion of the housing of image formation apparatus 1 and is provided downstream of fuser mechanism 27 in the conveyance direction of the sheet. The sheet on which the toner images are fixed is discharged into stacker 31.

Downstream of the secondary transfer nip portion in the conveyance direction of intermediate transfer belt 12, cleaning blade 33 is placed opposite cleaning blade opposing roller 34 with intermediate transfer belt 12 interposed in between. Cleaning blade 33 removes: post-secondary transfer residual toner which is not transferred onto the sheet in the secondary transfer nip portion and thus remains on intermediate transfer belt 12; and toner which adheres to secondary transfer roller 26 and is thereafter returned onto intermediate transfer belt 12 by applying cleaning voltages to the toner. Cleaning blade 33 is made of flexible rubber material or plastic material. Cleaning blade 33 scrapes the post-secondary transfer residual toner remaining on intermediate transfer belt 12, and the like, from intermediate transfer belt 12 into waste toner tank 35.

Figure 2:
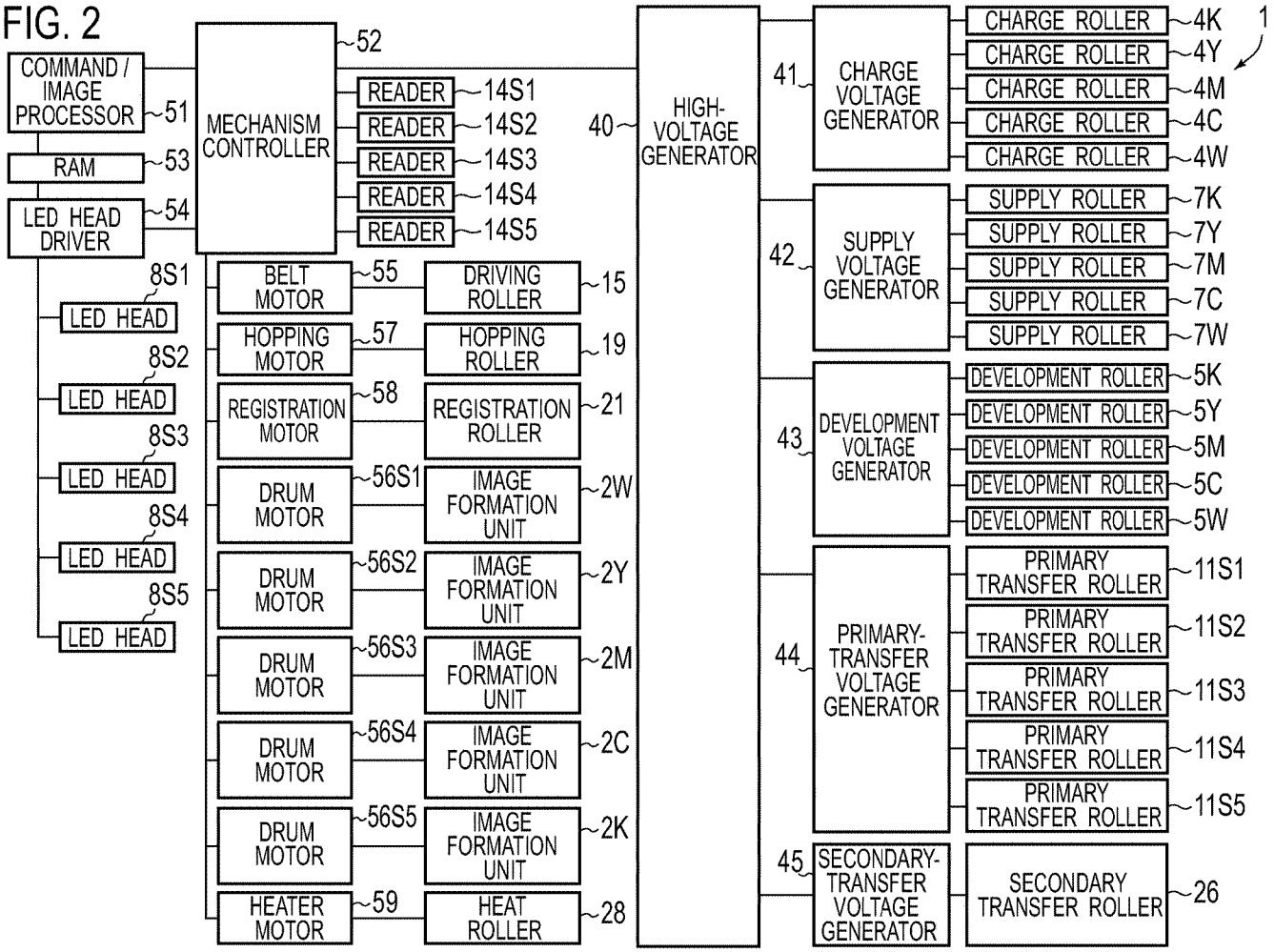
FIG. 2 is a block diagram illustrating a control configuration of the image formation apparatus of the embodiment.

FIG. 2 is a block diagram illustrating a control configuration of the image formation apparatus of the embodiment. In FIG. 2, image formation apparatus 1 is formed from high voltage controller 40, charge voltage generator 41, supply voltage generator 42, development voltage generator 43, primary-transfer voltage generator 44, secondary-transfer voltage generator 45, command/image processor 51, mechanism controller 52, RAM 53 and LED head driver 54.

Command/image processor 51 receives the image data and a command as an instruction from the host computer as a host apparatus, develops the received image data into bit-map data by processing the received image data, and writes the bit-map data onto RAM (Random Access Memory) 53. On the basis of the data written onto RAM 53, LED head driver 54 drives LED heads 8S1, 8S2, 8S3, 8S4, 8S5.

Mechanism controller 52 controls the units in the engine section of image formation apparatus 1. Following an instruction from command/image processor 51, mechanism controller 52 controls the drive of belt motor 55, hopping motor 57, registration motor 58, drum motors 56S1, 56S2, 56S3, 56S4, 56S5 and heat motor 59, as well as thereby operates driving roller 15, hopping roller 19, registration roller 21, image formation units 2W, 2Y, 2M, 2C, 2K and heat roller 28.

Furthermore, mechanism controller 52 checks readers 14S1, 14S2, 14S3, 14S4, 14S5 configured to read RF tags 13W, 13Y, 13M, 13C, 13K provided to image formation units 2W, 2Y, 2M, 2C, 2K at a predetermined timing, and thereby makes a judgement on the order of arrangement of the image formation units.

Following an instruction from mechanism controller 52, high voltage controller 40 controls charge voltage generator 41, supply voltage generator 42, development voltage generator 43, primary-transfer voltage generator 44 and secondary-transfer voltage generator 45. Following an instruction from high voltage controller 40, charge voltage generator 41 generates, and stops the generation of, charge voltages to charge rollers 4K, 4Y, 4M, 4C, 4W.

Following an instruction from high voltage controller 40, supply voltage generator 42 generates, and stops the generation of, supply voltages to supply rollers 7K, 7Y, 7M, 7C, 7W. Following an instruction from high voltage controller 40, development voltage generator 43 generates, and stops the generation of, development voltages to development rollers 5K, 5Y, 5M, 5C, 5W. Following an instruction from high voltage controller 40, primary-transfer voltage generator 44 generates, and stops the generation of, primary-transfer voltages to primary-transfer rollers 11S1, 11S2, 11S3, 11S4, 11S5.

As the voltage supply unit, secondary-transfer voltage generator 45 supplies voltages to secondary transfer roller 26. Secondary-transfer voltage generator 45 is capable of generating a voltage of a positive polarity and a voltage of a negative polarity. Following an instruction from high voltage controller 40, secondary-transfer voltage generator 45 switches the polarities of the voltages to be applied to secondary transfer roller 26, as well as generates, and stops the generation of, the voltages. Secondary-transfer voltage generator 45 supplies secondary transfer roller 26 with: a secondary-transfer voltage for transferring the toner images from intermediate transfer belt 12 onto the record medium; and a cleaning negative voltage and a cleaning positive voltage to be supplied to secondary transfer roller 26 before the supply of the secondary-transfer voltage.

In the embodiment, under the control by mechanism controller 52 and high voltage controller 40, secondary-transfer voltage generator 45 changes the cleaning negative voltage and the cleaning positive voltage to be supplied to secondary transfer roller 26 before the supply of the secondary-transfer voltage for transferring the toner images from intermediate transfer belt 12, illustrated in FIG. 1, onto the record medium. This change of the cleaning voltage depends on the arrangement of image formation units 2 in the conveyance direction of intermediate transfer belt 12, that is to say, it depends on the kind of image formation unit 2 placed most downstream in the conveyance direction of intermediate transfer belt 12.

Particularly in the embodiment, secondary-transfer voltage generator 45 is configured to change the cleaning negative voltage and the cleaning positive voltage to be supplied to secondary transfer roller 26 before the supply of the secondary-transfer voltage, depending on the arrangement position of image formation unit 2 that is configured to form an image from a toner which is easier to charge with an opposite polarity than the toners used in the other image formation units 2. In other words, the change of the cleaning voltage depends on the arrangement position of image formation unit 2W configured to form the white toner image.

Figure 3:
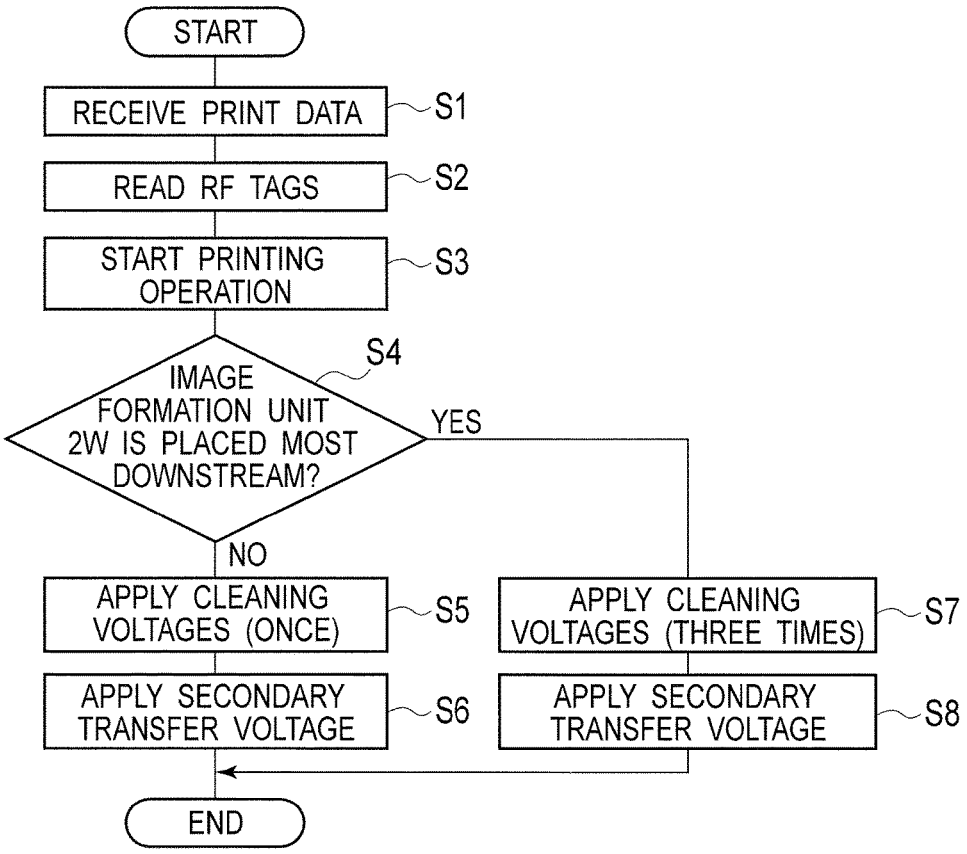
FIG. 3 is a flowchart illustrating a flow of an image formation process of the embodiment.

Descriptions are provided for how the foregoing configuration works. Referring to FIGS. 1 and 2, an image formation process performed by the image formation apparatus is described in accordance with the sequence of steps indicated with the letter S in FIG. 3 which is a flowchart illustrating a flow of the image formation process in the embodiment.

S1: Command/image processor 51 of image formation apparatus 1 receives the image data which is transmitted from the host computer. Command/image processor 51 generates the bit-map data by performing the development process on the received data, and stores the bit-map data onto RAM 53.

S2: Once command/image processor 51 completes the generation of the bit-map data, mechanism controller 52 reads the toner color information, which is stored in RF tags 13W, 13Y, 13M, 13C, 13K of image formation units 2W, 2Y, 2M, 2C, 2K disposed in image formation apparatus 1, using readers 14S1, 14S2, 14S3, 14S4, 14S5. On the basis of the information read from RF tags 13W, 13Y, 13M, 13C, 13K, mechanism controller 52 makes a judgment on the order of arrangement of the image formation units. For example, mechanism controller 52 in image formation apparatus 1 illustrated in FIG. 1 judges that from the upstream side in the conveyance direction of intermediate transfer belt 12, image formation units 2 are arranged in the order of from white (W), yellow (Y), magenta (M) and cyan (C) to black (K).

S3: Once mechanism controller 52 completes making the judgement on the order of arrangement of the image formation units, image formation apparatus 1 starts the printing operation. First of all, mechanism controller 52 controls belt motor 55 and drum motors 56S1, 56S2, 56S3, 56S4, 56S5, as well as thereby drives driving roller 15 and image formation units 2W, 2Y, 2M, 2C, 2K. Thus, mechanism controller 52 conveys intermediate transfer belt 12 in the direction indicated with arrow A illustrated in FIG. 1.

Once starting the conveyance of intermediate transfer belt 12, mechanism controller 52 drives charge voltage generator 41, supply voltage generator 42 and development voltage generator 43 by controlling high voltage controller 40, as well as supplies predetermined voltages, respectively, to charge rollers 4K, 4Y, 4M, 4C, 4W, supply rollers 7K, 7Y, 7M, 7C, 7W and development rollers 5K, 5Y, 5M, 5C, 5W. Next, descriptions are provided for how each image formation unit 2 operates in order to form its toner image. Incidentally, the toner image formation operation is the same among image formation units 2W, 2Y, 2M, 2C, 2K for the respective colors. For this reason, the following descriptions are provided without using reference signs W, Y, M, C and K.

To begin with, mechanism controller 52 drives charge voltage generator 41 by controlling high voltage controller 40. Thereby, mechanism controller 52 applies a voltage of −1000 V to charge rollers 4, and charges the surfaces of photosensitive drums 3 with −600 V. Once charging photosensitive drums 3, mechanism controller 52 controls LED head driver 54 on the basis of the generated bit-map data, and thus makes LED heads 8 (S1, S2, S3, S4, S5) emit light. Thereby, mechanism controller 52 exposes photosensitive drums 3 to the light to remove electricity to a level of −50 V, and forms the electrostatic latent images on photosensitive drums 3. The electrostatic latent images formed on photosensitive drums 3 reach contact portions between photosensitive drums 3 and development rollers 5 in conjunction with the rotations of photosensitive drums 3, respectively.

Furthermore, mechanism controller 52 drives supply voltage generator 42 and development voltage generator 43 by controlling high voltage controller 40. Thereby, mechanism controller 52 applies a voltage of −200 V to development rollers 5, and applies a voltage of −250 V to supply rollers 7. By this, the toners supplied from toner cartridges 10 are charged with the negative polarity through their friction with development rollers 5 and supply rollers 7. After being charged with the negative polarity through their friction with development rollers 5 and supply rollers 7, the toners adhere onto development rollers 5 due to the potential difference between development rollers 5 and supply rollers 7. Development blades 6 forms toner layers on development rollers 5 from the toners adhering on development rollers 5 by making the adhering toners become even to a uniform thickness. The rotations of development rollers 5 convey the toner layers formed on development rollers 5 to the contact portions between photosensitive drums 3 and development rollers 5.

Between the development rollers and photosensitive drums 3, electric fields directed from photosensitive drums 3 toward development rollers 5 are formed in the light-exposed portions of the surfaces of photosensitive drums 3, from which the electricity is removed to the level of −50V. For this reason, the toners charged with the negative polarity on development rollers 5 adhere from development rollers 5 to the light-exposed portions of the surfaces of photosensitive drums 3. The adhesion forms the toner images on the surfaces of photosensitive drums 3. In this manner, the toners as the developers are charged with the negative polarity which is one of the normal polarities, and are developed on the electrostatic latent images on photosensitive drums 3.

Meanwhile, the toner on each development roller 5 includes toner charged with the positive polarity, and toner with a smaller amount of electric charge. An electric field directed from development roller 5 toward photosensitive drum 3 is formed in the light-unexposed portion of the surface of photosensitive drum 3 which remained charged with the voltage of −600 V because of no electricity removal. For this reason, positive-polarity toner not charged with the normal polarity on development roller 5 adheres to the light-unexposed portion of the surface of photosensitive drum 3, that is to say, adheres to the outside of the image formation area (hereinafter referred to as a "non-image formation area" from time to time) on the surface of photosensitive drum 3. The toner not charged with the normal polarity, and accordingly adhering to the non-image formation area, is referred to as "fog toner."

The fog toner causes a problem in that when the record medium is carried to the non-image formation area on intermediate transfer belt 12 which does not pass the secondary transfer nip portion, the fog toner adheres to secondary transfer roller 26 which comes into contact with the record medium; and for this reason, the fog toner smears the back side of the record medium by adhering to the back surface of the record medium during the ensuing print.

Next, mechanism controller 52 drives primary-transfer voltage generator 44 by controlling high voltage controller 40, and applies a voltage of +1000 V to primary transfer rollers 11 (S1, S2, S3, S4, S5). Thereby, the toner images on photosensitive drums 3 are transferred to intermediate transfer belt 12 which is conveyed in the direction indicated with arrow A in FIG. 1.

S4: On the basis of the information read from RF tags 13W, 13Y, 13M, 13C, 13K, mechanism controller 52 judges whether or not image formation unit 2W is placed most downstream in the conveyance direction of intermediate transfer belt 12. If mechanism controller 52 judges that image formation unit 2W is placed most downstream, mechanism controller 52 makes the process proceed to step S7. If mechanism controller 52 judges that image formation unit 2W is not placed most downstream, mechanism controller 52 makes the process proceed to step S5.

Figure 6:
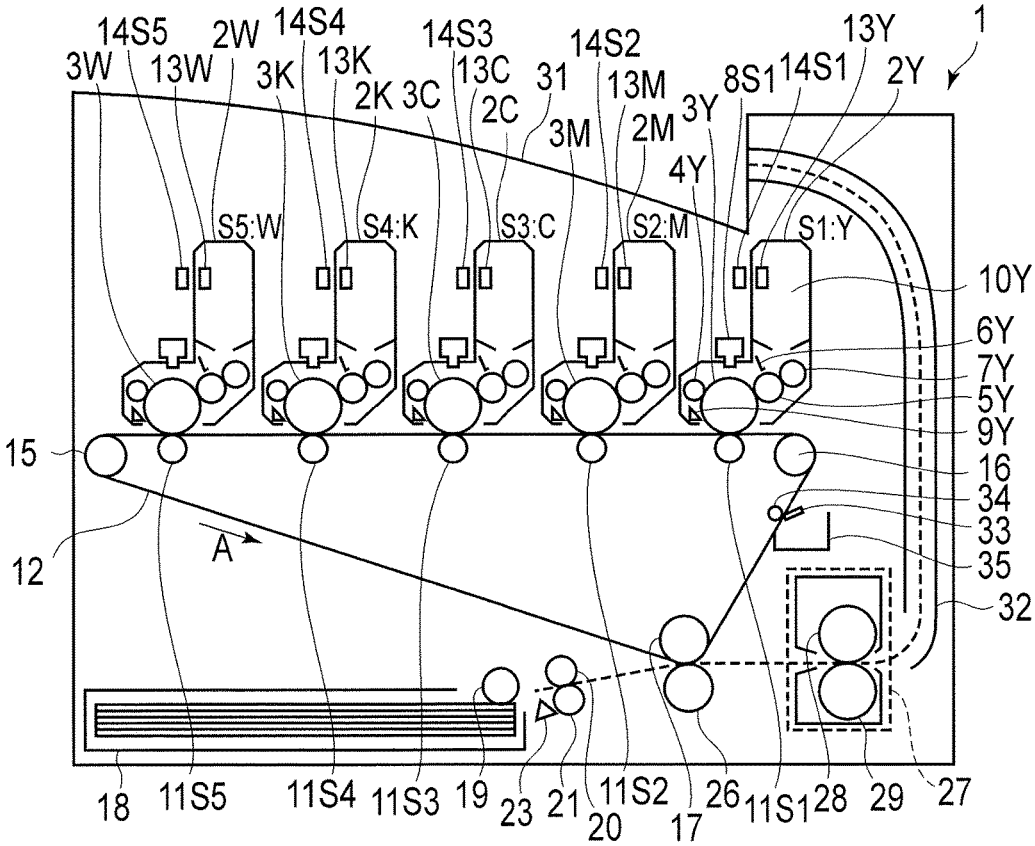
FIG. 6 is a schematic cross-sectional view illustrating a configuration of the image formation apparatus of the embodiment in which the arrangement of the image formation units is changed.

If as illustrated in FIG. 1, from the upstream side in the conveyance direction of intermediate transfer belt 12, image formation units 2 are arranged in the order of from white (W), yellow (Y), magenta (M) and cyan (C) to black (K), mechanism controller 52 makes the process proceed to step S5. If as illustrated in FIG. 6, from the upstream side in the conveyance direction of intermediate transfer belt 12, image formation units 2 are arranged in the order of from yellow (Y), magenta (M), cyan (C) and black (K) to white (W), mechanism controller 52 makes the process proceed to step S7.

Figure 4:
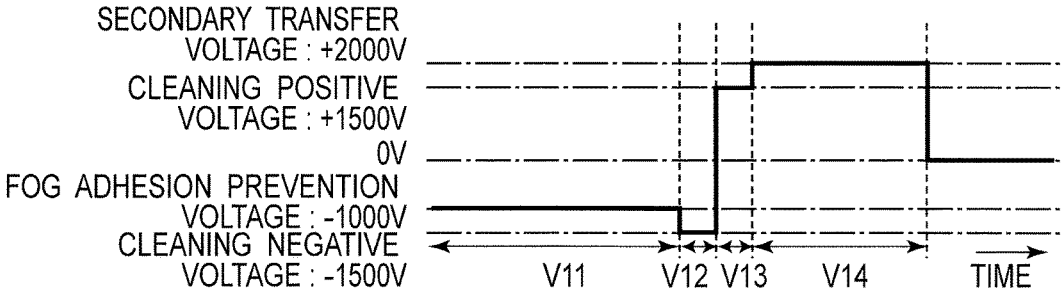
FIG. 4 is a graph of a secondary transfer voltage of the embodiment.

S5: Once mechanism controller 52 judges that image formation unit 2W is not placed most downstream in the conveyance direction of intermediate transfer belt 12, mechanism controller 52 starts the printing operation. Once mechanism controller 52 starts the conveyance of intermediate transfer belt 12, mechanism controller 52 applies fog adhesion prevention voltage V11 to secondary transfer roller 26, as illustrated in FIG. 4. Fog adhesion prevention voltage V11 is a voltage configured to reduce the adhesion of the fog toner to secondary transfer roller 26. Fog adhesion prevention voltage V11 of −1000 V is applied to secondary transfer roller 26.

Furthermore, after applying fog adhesion prevention voltage V11 to secondary transfer roller 26, mechanism controller 52 applies voltages, which are configured to return the fog toner adhering to secondary transfer roller 26 to intermediate transfer belt 12, to secondary transfer roller 26 in an order from cleaning negative voltage V12 (−1500 V) to cleaning positive voltage V13 (+1500 V) before the record sheet reaches the second transfer nip portion, as illustrated in FIG. 4. The application of the positive and negative cleaning voltages to secondary transfer roller 26 like this makes it possible to return the toners on secondary transfer roller 26, which are charged with the positive and negative polarities, to intermediate transfer belt 12, and accordingly to clean secondary transfer roller 26.

Meanwhile, the embodiment continues to apply cleaning negative voltage V12 (−1500 V) to secondary transfer roller 26 until intermediate transfer belt 12 is conveyed by a distance equal to the peripheral length (75 mm, for example) of secondary transfer roller 26, and thereafter continues to apply cleaning positive voltage V13 (+1500 V) to secondary transfer roller 26 until intermediate transfer belt 12 is conveyed by another distance equal to the peripheral length (75 mm, for example) of secondary transfer roller 26. The embodiment defines one round of cleaning operation as a combination of one application of the cleaning negative voltage and one application of the cleaning positive voltage.

If as illustrated in FIG. 1, from the upstream side in the conveyance direction of intermediate transfer belt 12, image formation units 2 are arranged in order from white (W), yellow (Y), magenta (M) and cyan (C) to black (K), mechanism controller 52 performs one round of cleaning operation.

S6: Once mechanism controller 52 completes the round of cleaning operation, mechanism controller 52 applies secondary transfer voltage V14 (+2000 V) to secondary transfer roller 26 simultaneously with the arrival of the record medium at the secondary transfer nip portion, and thereby transfers the toner images, which are formed on intermediate transfer belt 12, onto the record medium.

The record medium with the toner images transferred on it is sent to fuser mechanism 27. Once the record medium arrives at fuser mechanism 27, pressure roller 29 and heat roller 28, whose temperature is controlled so as to be equal to a temperature at which the toners can be fused, convey the record medium while heating and pressing the record medium. During the heated and pressed conveyance, the toner images are fixed to the record medium. Transfer guide 32 guides and discharges the record medium with the toner images fixed on it to stacker 31. The image formation process ends with this action.

Figure 5:
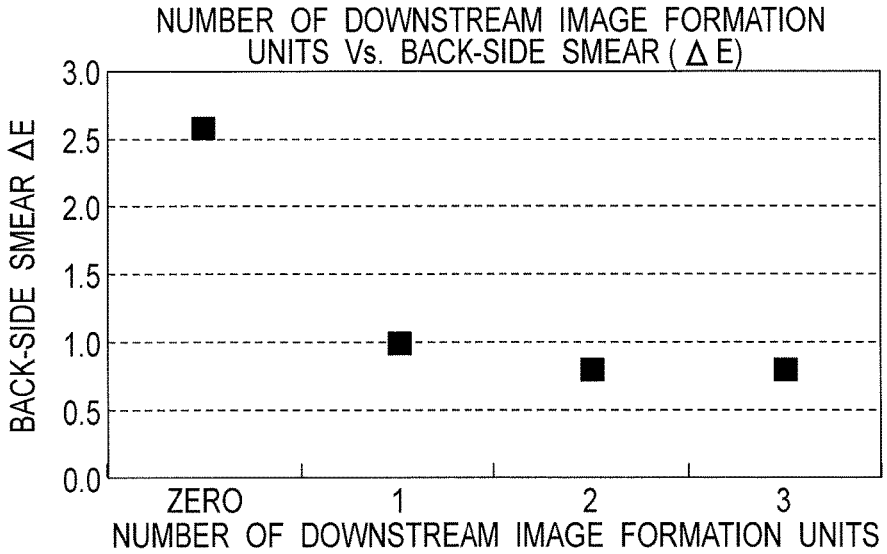
FIG. 5 is a graph presenting a relationship between the number of image formation units and back-side smear in the embodiment.

FIG. 5 is a graph presenting a relationship between the number of image formation units and the back-side stain in the embodiment in which white image formation unit 2W is placed most upstream in the conveyance direction of intermediate transfer belt 12 and one round of cleaning operation is performed. Here, the relationship between the number of image formation units and the back-side stain is obtained from OHP sheets printed by changing the number of image formation units placed downstream of image formation unit 2W.

OHP sheets are used as the record media, and a color difference (ΔE) is used as a criterion in the method of observing back-side smear. Using a spectrophotometer (CM-2600d, made by Konica Minolta, Inc.), the spectrophotometry is carried out as follows. For each printed OHP sheet, the color difference (ΔE) is calculated by comparing Lab values obtained by measurement on a non-image part of the printed OHP sheet placed on a black sheet with Lab values obtained by measurement made on an unprinted OHP sheet placed on a black sheet. A smaller color difference (ΔE) means a smaller amount of the combination of fog and back-side smear of the OHP sheet. If the color difference (ΔE) is not greater than 1.2, the experiment judges that neither the fog nor the smear is serious because both the fog and the smear are invisible.

It is learned from FIG. 5 that one round of the cleaning operation for secondary transfer roller 26 is enough to reduce the fog and the back-side smear to an unproblematic level in the case where one or more image formation units are placed downstream of image formation unit 2W, that is to say, in the case where there is at least one image formation unit which is placed downstream of image formation unit 2W. This is because the image formation unit(s) placed downstream of image formation unit 2W collects the fog toner by reversely transferring the fog toner, and thereby makes an amount of back-side smear smaller than otherwise.

Figure 7:
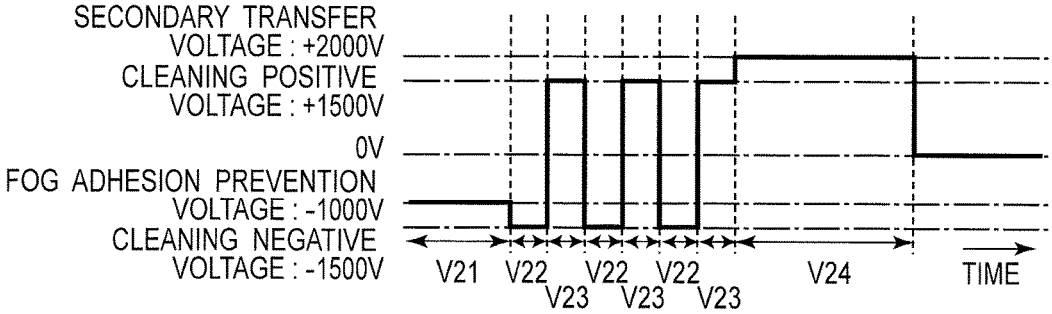
FIG. 7 is a graph of another secondary transfer voltage of the embodiment.

S7: Once mechanism controller 52 judges in step S4 that image formation unit 2W is placed the most downstream in the conveyance direction of intermediate transfer belt 12, mechanism controller 52 starts the printing operation. Once mechanism controller 52 starts the conveyance of intermediate transfer belt 12, mechanism controller 52 applies fog adhesion prevention voltage V21 to secondary transfer roller 26, as illustrated in FIG. 7. Fog adhesion prevention voltage V21 is a voltage configured to reduce the adhesion of the fog toner to secondary transfer roller 26. A fog adhesion prevention voltage V21 of −1000 V is applied to secondary transfer roller 26.

Furthermore, after applying fog adhesion prevention voltage V21 to secondary transfer roller 26, mechanism controller 52 applies voltages, which are configured to return the fog toner adhering to secondary transfer roller 26 to intermediate transfer belt 12, to secondary transfer roller 26 by repeating the application of cleaning negative voltage V22 (−1500 V) and the application of cleaning positive voltage V23 (+1500 V) in this sequence three times before the record sheet reaches the second transfer nip portion, as illustrated in FIG. 7. If as illustrated in FIG. 6, from the upstream side in the conveyance direction of intermediate transfer belt 12, image formation units 2 are arranged in the order of from yellow (Y), magenta (M), cyan (C) and black (K) to white (K), mechanism controller 52 performs three repeated rounds of cleaning operation.

The reason why mechanism controller 52 performs the three repeated rounds of cleaning operation is that when mechanism controller 52 applies cleaning negative voltage V22 (−1500 V) or cleaning positive voltage V23 (+1500 V) to secondary transfer roller 26, the first turn of secondary transfer roller 26 is still effective in returning the fog toner adhering to secondary transfer roller 26 to intermediate transfer belt 12.

S8: Once mechanism controller 52 completes the three rounds of cleaning operation, mechanism controller 52 applies secondary transfer voltage V24 (+2000 V) to secondary transfer roller 26 simultaneously with the arrival of the record medium at the secondary transfer nip portion, and thereby transfers the toner images, which are formed on intermediate transfer belt 12, onto the record medium.

As described above, under the control by mechanism controller 52 and high voltage controller 40, secondary-transfer voltage generator 45 makes the number of repetitions of the supply of cleaning negative voltage V22 (−1500 V) and cleaning positive voltage V23 (+1500 V), which are the voltages supplied before the supply of secondary transfer voltage V24, become larger in the case where image formation unit 2W is placed most downstream in the conveyance direction of intermediate transfer belt 12 than in the case where image formation unit 2W is not placed most downstream. The record medium with the toner images transferred on it is sent to fuser mechanism 27. Fuser mechanism 27 fixes the toner images to the record medium. Thereafter, transfer guide 32 discharges the resultant record medium to stacker 31. The image formation process ends with this action.

Figure 8:
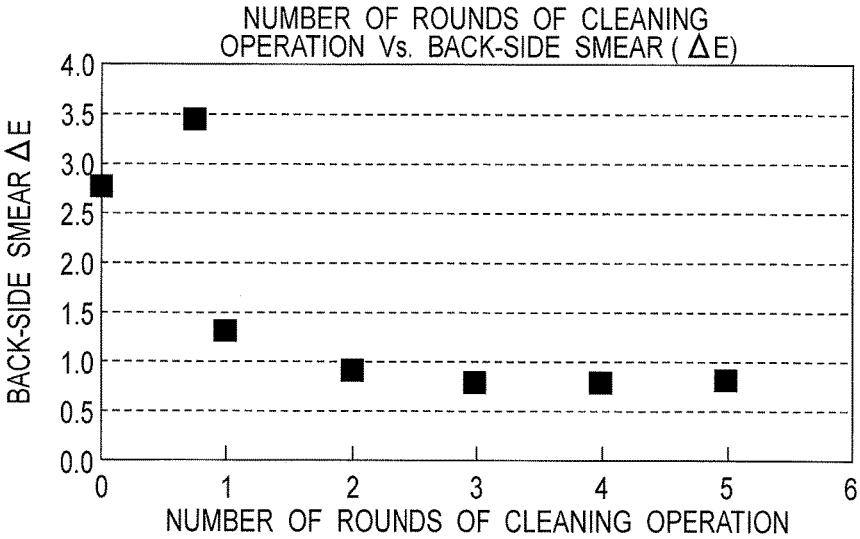
FIG. 8 is a graph presenting a relationship between the number of rounds of cleaning operation and back-side smear in the embodiment.

FIG. 8 is a graph presenting a relationship between the number of rounds of the cleaning operation and the back-side stain in the embodiment in which the image formation apparatus includes no image formation unit placed downstream of white image formation unit 2W in the conveyance direction of intermediate transfer belt 12. Here, the relationship between the number of rounds of the cleaning operation and the back-side stain is obtained from OHP sheets printed by the image formation apparatus changing the number of rounds of the cleaning operation. The method used for this experiment is the same as the above-described method.

It is learned from FIG. 8 that in the case where no image formation unit is placed downstream of image formation unit 2W, an increase in the number of rounds of the cleaning operation for secondary transfer roller 26 (the increase to two or more in the embodiment) reduces the fog and the back-side smear to an unproblematic level. For this reason, in the case where image formation unit 2W is placed the most downstream in the conveyance direction of intermediate transfer belt 12, the increase in the number of rounds of the cleaning operation makes it possible to inhibit the back-side smear.

Figure 9:
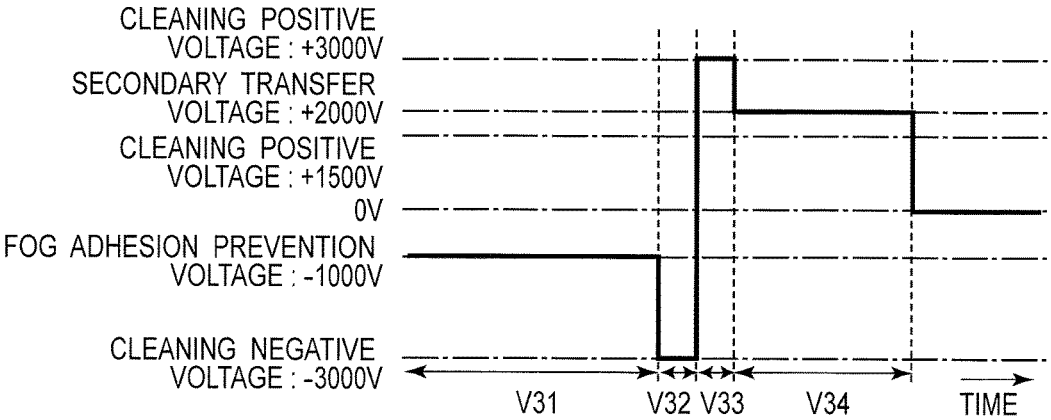
FIG. 9 is a graph of yet another secondary transfer voltage of the embodiment.

The embodiment is configured such that in the case where no image formation unit is placed downstream of image formation unit 2W, secondary-transfer voltage generator 45 alternately applies cleaning negative voltage V22 (−1500 V) and cleaning positive voltage V23 (+1500 V) three times, as illustrated in FIG. 7. Meanwhile, even if as illustrated in FIG. 9, mechanism controller 52 performs the cleaning operation only once by using cleaning negative voltage V32 (−3000 V) and cleaning positive voltage V33 (+3000 V), the back-side smear can be inhibited, too.

Figure 10:
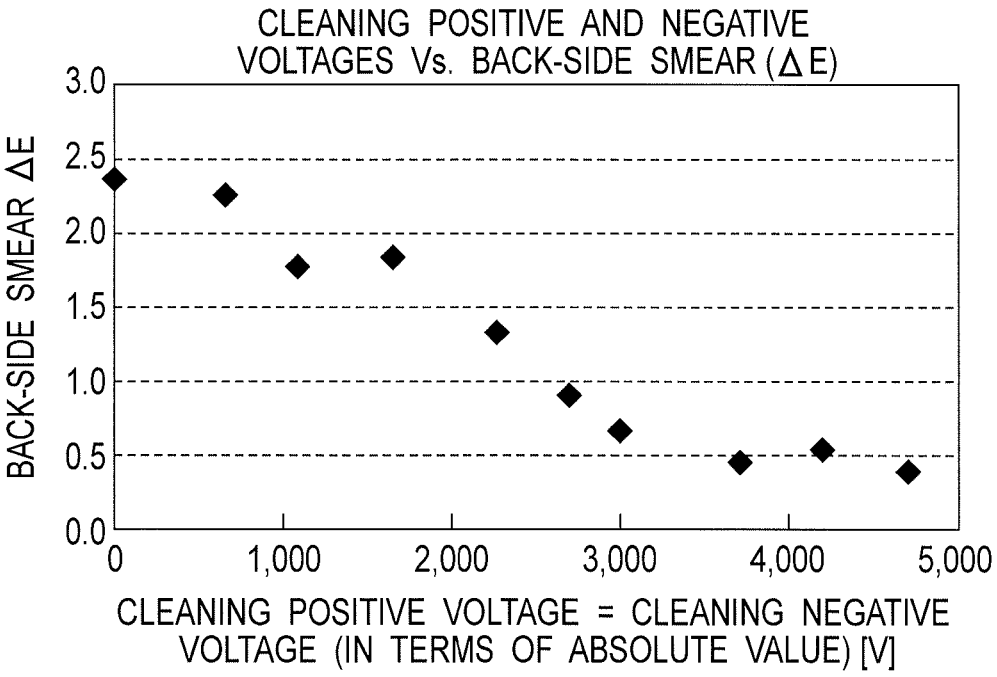
FIG. 10 is a graph presenting a relationship between cleaning positive and negative voltages and back-side smear in the embodiment.

FIG. 10 is a graph presenting a relationship between the cleaning positive and negative voltages and the back-side smear in the embodiment in which the image formation apparatus includes no image formation unit placed downstream of white image formation unit 2W in the conveyance direction of intermediate transfer belt 12. Here, the relationship between the cleaning positive and negative voltages and the back-side smear is obtained from OHP sheets printed by the image formation apparatus changing the cleaning negative voltage and the cleaning positive voltage simultaneously, and the method used for this experiment is the same as the above-described method.

It is learned from FIG. 10 that in the case where no image formation unit is placed downstream of image formation unit 2W, an increase in the absolute values of the cleaning negative and positive voltages reduces the fog and the back-side smear to an unproblematic level. For this reason, in the case where image formation unit 2W is placed the most downstream in the conveyance direction of intermediate transfer belt 12, the increase in the absolute values of the cleaning negative and positive voltages makes it possible to inhibit the back-side smear.

As described above, secondary-transfer voltage generator 45 may be configured to, under the control by mechanism controller 52 and high voltage controller 40, make the absolute values of cleaning negative voltage V32 (−3000 V) or cleaning positive voltage V33 (+3000 V), which are the voltages supplied before the supply of secondary transfer voltage V24, become higher (larger) in the case where image formation unit 2W is placed most downstream in the conveyance direction of intermediate transfer belt 12 than in the case where image formation unit 2W is not placed most downstream.

Instead of alternately applying cleaning negative voltage V22 (−1500 V) and cleaning positive voltage V23 (+1500 V) to secondary transfer roller 26 three times, the length of time of application of the cleaning negative voltage V22 (−1500 V) and cleaning positive voltage V23 (+1500 V) may be increased, so that the back-side smear can be inhibited. In this case, for example, cleaning negative voltage V12 (−1500 V) is applied to secondary transfer roller 26 until intermediate transfer belt 12 is conveyed by a distance equal to three times the peripheral length of secondary transfer roller 26, and thereafter cleaning positive voltage V13 (+1500 V) is applied to secondary transfer roller 26 until intermediate transfer belt 12 is conveyed by a distance equal to three times the peripheral length of secondary transfer roller 26.

As described above, under the control of mechanism controller 52 and high voltage controller 40, secondary-transfer voltage generator 45 may make the length of time of the application of cleaning negative voltage V22 (−1500 V) or cleaning positive voltage V23 (+1500 V), which are the voltages supplied before the supply of secondary transfer voltage V24, become longer in the case where image formation unit 2W is placed most downstream in the conveyance direction of intermediate transfer belt 12 than in the case where image formation unit 2W is not placed most downstream.

As described above, image formation apparatus 1 in which the arrangement of image formation units 2 can be changed is configured to perform the optimum cleaning operation for secondary transfer roller 26 before the application of the secondary transfer voltage to secondary transfer roller 26, depending on the position of white image formation unit 2W liable to cause much fog (the kind of image formation unit 2 placed most downstream in the conveyance direction of intermediate transfer belt 12). For this reason, image formation apparatus 1 is capable of inhibiting the adhesion of the fog toner to secondary transfer roller 26, and inhibiting the smear on the back side of the record medium. Furthermore, the life of the apparatus can be extended since image formation apparatus 1 allows the number of rounds of cleaning operation and the cleaning voltages for secondary transfer roller 26 to be changed depending on the position of white image formation unit 2W.

In addition, since secondary-transfer voltage generator 45 makes the number of rounds of cleaning operation or the absolute values of the cleaning voltages become larger in the case where white image formation unit 2W is placed the most downstream in the conveyance direction of intermediate transfer belt 12 than in the case where white image formation unit 2W is not placed the most downstream, it is possible to inhibit the adhesion of the fog toner to secondary transfer roller 26 while extending the life of the apparatus, and to inhibit the smear on the back side of the record medium.

As described above, since the image formation apparatus of the embodiment is configured to perform the optimum cleaning operation for the secondary transfer roller depending on the position of the placement of the image formation unit using the white toner, it is possible to obtain the effect of inhibiting the adhesion of the fog toner to the secondary transfer roller, and the effect of inhibiting the smear on the back side of the record medium. It should be noted that although the embodiment is described by citing the printer as the image formation apparatus, the invention is not limited to this case. The invention is applicable to copy machines, facsimile machines and multi-function printers (MFPs) and the like each including image formation units.

Furthermore, although the embodiment is described by citing the case where the image formation unit using the white toner is placed the most upstream or the most downstream in the conveyance direction of the intermediate transfer belt, the embodiment may be modified such that the number of rounds of cleaning operation (cleaning time) increases as the image formation unit using the white toner is placed more downstream. For example, in the case where the image formation unit is placed in the second, third, fourth, or fifth place from the upstream side in the conveyance direction of the intermediate transfer belt, two, three, four or five rounds of cleaning operation may be performed, respectively.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An image formation apparatus comprising:

image formation units each configured to form a developer image, wherein arrangement of the image formation units is changeable;

an intermediate transfer body onto which the developer images formed by the respective image formation units are transferred;

a secondary transfer member configured to transfer the developer images, which are transferred to the intermediate transfer body, onto a record medium using a voltage supplied to the secondary transfer member; and a voltage supply unit configured to supply a voltage to the secondary transfer member, wherein the voltage includes a first voltage corresponding to a transfer voltage for transferring the developer images from the intermediate transfer body to the record medium and a second voltage, which is different from the transfer voltage, to be supplied before a supply of the transfer voltage, wherein depending on the arrangement of the image formation units in a conveyance direction of the intermediate transfer body, the voltage supply unit changes the second voltage to be supplied to the secondary transfer member.

2. The image formation apparatus according to claim 1, wherein in a case where a specific one of the image formation units is placed most downstream in the conveyance direction of the intermediate transfer body, the voltage supply unit makes a length of time of application of the second voltage to be supplied before the supply of the transfer voltage become longer than in a case where the specific image formation unit is not placed most downstream.

3. The image formation apparatus according to claim 2, wherein the specific image formation unit is an image formation apparatus configured to form an image of a developer which is more easily charged with an opposite polarity than those in the other image formation units.

4. The image formation apparatus according to claim 2, wherein the specific image formation unit is an image formation unit configured to form an image of white toner.

5. The image formation apparatus according to claim 1, wherein the second voltage to be supplied before the supply of the transfer voltage includes a negative voltage and a positive voltage, and in a case where a specific one of the image formation units is placed most downstream in the conveyance direction of the intermediate transfer body, the voltage supply unit supplies the negative voltage and the positive voltage repetitively more times than in a case where the specific image formation unit is not placed most downstream.

6. The image formation apparatus according to claim 5, wherein the voltage supply unit repeatedly supplies a voltage whose polarity is opposite to a charge voltage for the developer and a voltage whose polarity is the same as the charge voltage.

7. The image formation apparatus according to claim 5, wherein the voltage supply unit repeatedly supplies the negative voltage and the positive voltage.

8. The image formation apparatus according to claim 1, wherein in a case where a specific one of the image formation units is placed most downstream in the conveyance direction of the intermediate transfer body, the voltage supply unit makes the second voltage to be supplied before the supply of the transfer voltage become higher than in a case where the specific image formation unit is not placed most downstream.

9. The image formation apparatus according to claim 1, wherein the second voltage to be supplied before the supply of the transfer voltage includes a negative voltage and a positive voltage, and in a case where a specific one of the image formation units is placed most downstream in the conveyance direction of the intermediate transfer body, the voltage supply unit supplies the negative voltage and the positive voltage whose absolute value is made larger than in a case where the specific image formation unit is not placed most downstream.

10. An image formation apparatus comprising:

image formation units each configured to form a developer image;

an intermediate transfer body onto which the developer images formed by the respective image formation units are transferred;

a secondary transfer member configured to transfer the developer images, which are transferred to the intermediate transfer body, onto a record medium using a voltage supplied to the secondary transfer member; and a voltage supply unit configured to supply a voltage to the secondary transfer member, wherein the voltage includes a first voltage corresponding to a transfer voltage for transferring the developer images from the intermediate transfer body to the record medium and a second voltage, which is different from the transfer voltage, to be supplied before a supply of the transfer voltage, wherein depending on a type of color provided by the image formation unit placed most downstream in a conveyance direction of the intermediate transfer body, the voltage supply unit changes the second voltage to be supplied to the secondary transfer member.

11. The image formation apparatus according to claim 10, wherein depending on the type of color provided by the image formation unit placed most downstream in the conveyance direction of the intermediate transfer body, the voltage supply unit changes the second voltage to be supplied before a supply of the transfer voltage for transferring the developer images from the intermediate transfer body to the record medium.

12. The image formation apparatus according to claim 11, wherein in a case where a specific one of the image formation units is placed most downstream in the conveyance direction of the intermediate transfer body, the voltage supply unit makes a length of time of application of the second voltage to be supplied before the supply of the transfer voltage become longer than in a case where the specific image formation unit is not placed most downstream.

13. The image formation apparatus according to claim 12, wherein the specific image formation unit is an image formation unit configured to form an image of a developer which is more easily charged with an opposite polarity than those in the other image formation units.

14. The image formation apparatus according to claim 12, wherein the specific image formation unit is an image formation unit configured to form an image of white toner.

15. The image formation apparatus according to claim 11, wherein the second voltage to be supplied before the supply of the transfer voltage includes a negative voltage and a positive voltage, and in a case where a specific one of the image formation units is placed most downstream in the conveyance direction of the intermediate transfer body, the voltage supply unit supplies the negative voltage and the positive voltage repetitively more times than in a case where the specific image formation unit is not placed most downstream.

16. The image formation apparatus according to claim 11, wherein in a case where a specific one of the image formation units is placed most downstream in the conveyance direction of the intermediate transfer body, the voltage supply unit makes the second voltage to be supplied before the supply of the transfer voltage become higher than in a case where the specific image formation unit is not placed most downstream.

17. The image formation apparatus according to claim 11, wherein the second voltage to be supplied before the supply of the transfer voltage includes a negative voltage and a positive voltage, and in a case where a specific one of the image formation units is placed most downstream in the conveyance direction of the intermediate transfer body, the voltage supply unit supplies the negative voltage and the positive voltage whose absolute value is made larger than in a case where the specific image formation unit is not placed most downstream.

18. The image formation apparatus according to claim 17, wherein the voltage supply unit repeatedly supplies a voltage whose polarity is opposite to a charge voltage for the developer and a voltage whose polarity is the same as the charge voltage.

19. The image formation apparatus according to claim 17, wherein the voltage supply unit repeatedly supplies the negative voltage and the positive voltage.

* * * * *